US006128888A

United States Patent [19]

Gambetti

[11] Patent Number: 6,128,888

[45] Date of Patent: Oct. 10, 2000

[54] METHOD AND MACHINE FOR PACKAGING OF OBJECTS, BY MEANS OF PIECES OF SHEET MATERIAL OBTAINED FROM A CONTINUOUS STRIP

[75] Inventor: Mario Gambetti, Bologna, Italy

[73] Assignee: Baumer S.R.L., Castelfranco Emilia, Italy

[21] Appl. No.: 09/271,773

[22] Filed: Mar. 18, 1999

[30] Foreign Application Priority Data

Apr. 7, 1998 [IT] Italy ..... BO98A0227

[51] Int. Cl.[7] ..... B65B 11/00; B65B 13/04; B65B 49/00

[52] U.S. Cl. ..... 53/465; 53/210; 53/589

[58] Field of Search ..... 53/589, 210, 399, 53/465, 588, 389.3, 51

[56] References Cited

U.S. PATENT DOCUMENTS

| | | | |
|---|---|---|---|
| Re. 27,977 | 4/1974 | Monaghan | 53/210 |
| 3,001,352 | 9/1961 | Harrison | 53/389.3 |
| 4,876,842 | 10/1989 | Ausnit | 53/51 |
| 5,463,846 | 11/1995 | Gambetti | 53/589 X |

FOREIGN PATENT DOCUMENTS

| | | |
|---|---|---|
| 0 581 747 | 2/1994 | European Pat. Off. . |
| 0 629 551 | 12/1994 | European Pat. Off. . |

*Primary Examiner*—Linda Johnson
*Attorney, Agent, or Firm*—Herbert Dubno

[57] ABSTRACT

A method for packaging of objects (50), by means of pieces (32*a*) of sheet material, obtained from a continuous strip (32), comprises translation, with continual motion, of the objects (5) in individual succession, from upstream towards downstream, on three conveyors (1, 2, 3), and, for each object (50), during the wrapping operations, the transverse wrapping bar (14) is stopped during its path of longitudinal advance downstream, in a specific position, which is further forwards than the rear end of the object (50), and simultaneously, the means (25) of supply of a continuous strip (32) of packaging material are stopped, in order then to actuate cutting means (21), which cut off a piece (32*a*) from the said continuous strip (32) which is rendered stationary, and, when the cutting off has taken place, the advance of the wrapping bar (14) is resumed, and the packaging of the object (50) itself is completed. A machine for implementation of the said method.

7 Claims, 5 Drawing Sheets

METHOD AND MACHINE FOR PACKAGING OF OBJECTS, BY MEANS OF PIECES OF SHEET MATERIAL OBTAINED FROM A CONTINUOUS STRIP

SPECIFICATION

1. Field of the Invention

The present invention relates to a method and a machine for packaging of objects by means of pieces of sheet material obtained from a continuous strip.

More specifically, the present invention relates to the packaging of products, such as containers which are grouped in batches, in which individual pieces or sheets of heat-shrink material, obtained from a continuous strip which is unwound from a bobbin, are progressively cut individually, and again individually, are wrapped in the form of a sleeve around respective batches, and the individual assemblies of batch/piece thus obtained are conveyed to a heat-shrink oven, in order to shrink the pieces around containers.

2. Description of the Prior Art

At present, specific machines of this type, see for example patents GB-1,355,466 and U.S. Pat. No. 5,203,144, substantially comprise: a first conveyor, which is designed to supply the objects to be packaged, in spaced succession and with continual motion; a second conveyor, which is disposed downstream, and is slightly spaced relative to the first conveyor, thus providing a first aperture between the said first and the second conveyor, which is designed to translate the objects in succession, and with continual motion, along a wrapping surface; and a third conveyor, which is disposed downstream, and is slightly spaced relative to the said second conveyor, in order to provide a second aperture between the said second and third conveyor.

The third conveyor designed to collect in succession, and with continual motion, the partially wrapped objects presented by the said second conveyor. At least one suspended wrapping bar is oriented transversely relative to the direction of advance of the objects and is designed to be translated through the said first and the said second aperture, along an orbital path which circumscribes the said second conveyor, the upper translation path of which is oriented from upstream towards downstream, which is designed to transport the packaging material from upstream towards downstream, above the object and beneath the transport surface, by being passed through the said second aperture. Means is provided for supplying the packaging material and are disposed beneath and are aligned in the vicinity of the intake end of the second conveyor, and are designed to cut off pieces of packaging material obtained from a continuous strip unwound from a bobbin, and to supply the said pieces in individual succession during the wrapping steps which are implemented by the wrapping bar. Synchronizing means synchronise with one another the first, second and third conveyors, the suspended wrapping bar, and the means for supplying the packaging material.

To summarize, in order to package the objects, these machines use the following operative method: translation of the objects longitudinally in individual succession from upstream towards downstream, with continual motion, on the three conveyor belts; cutting of the continuous strip of packaging material into successive pieces which have a specific length; supplying the ready-cut pieces in phase with arrival of the objects on the second conveyor, the front end of each piece being disposed between a respective object and the transport surface of the second conveyor; moving the suspended wrapping bar with continual motion, making it emerge from the base towards the top through the said first aperture, when the end part of the objects has passed beyond the first aperture itself, and then, in the downstream direction and subsequently downwards, making it pass through the second aperture, before the objects reach the second aperture itself, in order to wrap the rear, upper and front parts of the individual objects, and in order to dangle the end part of the individual pieces between the second and the third conveyor; and finally, to fold the end part of the said pieces beneath the respective objects, and beneath the initial part of the pieces themselves, by translating the objects from the second to the third conveyor.

As a result of the operative method used, and of the relative functional components adopted, according to which firstly the pieces are cut cyclically, are then supplied in succession on the second conveyor, and then drawn around the objects to be packaged, the aforementioned known machines require the use of rotary blades which are provided with clutches and brakes, and also the use of piece conveyor belts which are also provided with brakes and clutches, thus giving rise to a considerable cost of production of the packaging machine.

In addition, again as a result of the operative method used, and of the relative components adopted, the aforementioned machines are suitable for packaging lines for high productivity, in which the format is changed intermittently, and have the disadvantage that they are not designed for rapid, simple execution of the change of format.

OBJECT OF THE INVENTION

The object of the present invention is to eliminate the above-described disadvantages.

SUMMARY OF THE INVENTION

The invention, solves the problem of creating a method and a machine for packaging of objects by means of pieces of sheet material obtained from a continuous strip.

The method of objects by means of pieces of sheet material, obtained from a continuous strip, in an automatic packaging machine of the "sleeve" type, which wraps pieces of packaging material around the objects. The machine comprises: first conveyor means which can supply the objects longitudinally in spaced succession; second conveyor means, which are disposed downstream and slightly spaced relative to the said first conveyor means, thus providing a first aperture between the said first and the second conveyor means, and can translate the objects longitudinally along a wrapping surface which has an intake end and an output end; and third conveyor means, which are disposed downstream and slightly spaced relative to the said second conveyor means, thus providing a second aperture between the said second and the said third conveyor means, which can collect longitudinally the objects presented by the said second conveyor means. Wrapping means are disposed in the vicinity of the second conveyor means and include at least one suspended wrapping bar, which is oriented transversely relative to the direction of advance of the objects, and is designed to be translated through the said first and the said second aperture, along an orbital path which circumscribes the said conveyor means, and is designed to transport the packaging material. Strip supply means are disposed beneath and aligned in the vicinity of the intake end of the second conveyor means, and are designed to supply a continuous strip of packaging material. A cutting means is disposed between the strip supply means and the intake end of the second conveyor means and is designed to cut the continuous strip of packaging material transversely. Synchronization means is provided to synchronize the said means with one another. According to the invention the objects are translated with continual motion, in individual succession, from upstream towards downstream, and for each object to be packaged, there is: a) supply of the front end of the strip towards the intake end of the said second conveyor means, in phase with the arrival of the object on the second conveyor, the front end of the strip being disposed between the object and the transport surface of the second conveyor means; b) passage of a transverse wrapping bar upwards through the said first aperture, when the rear end of the object has passed beyond the said first aperture, and drawing of the strip supplied above the object and in the downstream direction; c) stoppage of the said transverse wrapping bar during its path of advance downstream, in a specific position which is further forwards than the rear end of the object, which advances with continual motion; d) simultaneously with the preceding step c), stoppage of the means for supply of the strip of packaging material; e) actuation of the cutting means and cutting off of the continuous strip which is rendered stationary, thus obtaining a piece; f) resumption of the advance in the downstream direction of the transverse wrapping bar, and conveying the bar beyond the object and then downwards, making it pass through the said second aperture before the object reaches the second aperture itself, dangling the end part of the piece between the said second conveyor means and the said third conveyor means; and g) translation of the object from the second conveyor means to the third conveyor means, and placing the end part of the piece beneath the object.

The machine of the invention has detection means along the longitudinal extension of the second conveyor, which can detect the position of longitudinal advance of the objects. The wrapping means are actuated by means of a first servomotor with speed and phase control. The said means for supplying the material comprise strip supply units which are actuated by a second servomotor with speed and phase control. The synchronizing means can comprise a programmable control unit, which is connected to the detection means, and can control the first servomotor, the second servo-motor, and the cutting units.

By means of use of a method and a machine of this type, the following results are obtained: rotary blades which are provided with brakes and clutches are not required; piece conveyor belts which are provided with brakes and clutches are not required; and the operations for the change of format are simplified.

The advantages which are obtained by means of the present invention consist mainly of: simplification of the wrapping operations; reduction of the costs of production of the machine for packaging of objects; an increase in the capacities of adaptation of the machine to the various formats of objects to be packaged; and reduction of the operative times for carrying out the change of format.

BRIEF DESCRIPTION OF THE DRAWINGS

Further characteristics and advantages of the present invention will become more apparent from the following detailed description of a preferred practical embodiment, with reference to the attached drawings, in which.

SPECIFIC DESCRIPTION

Figure 1:
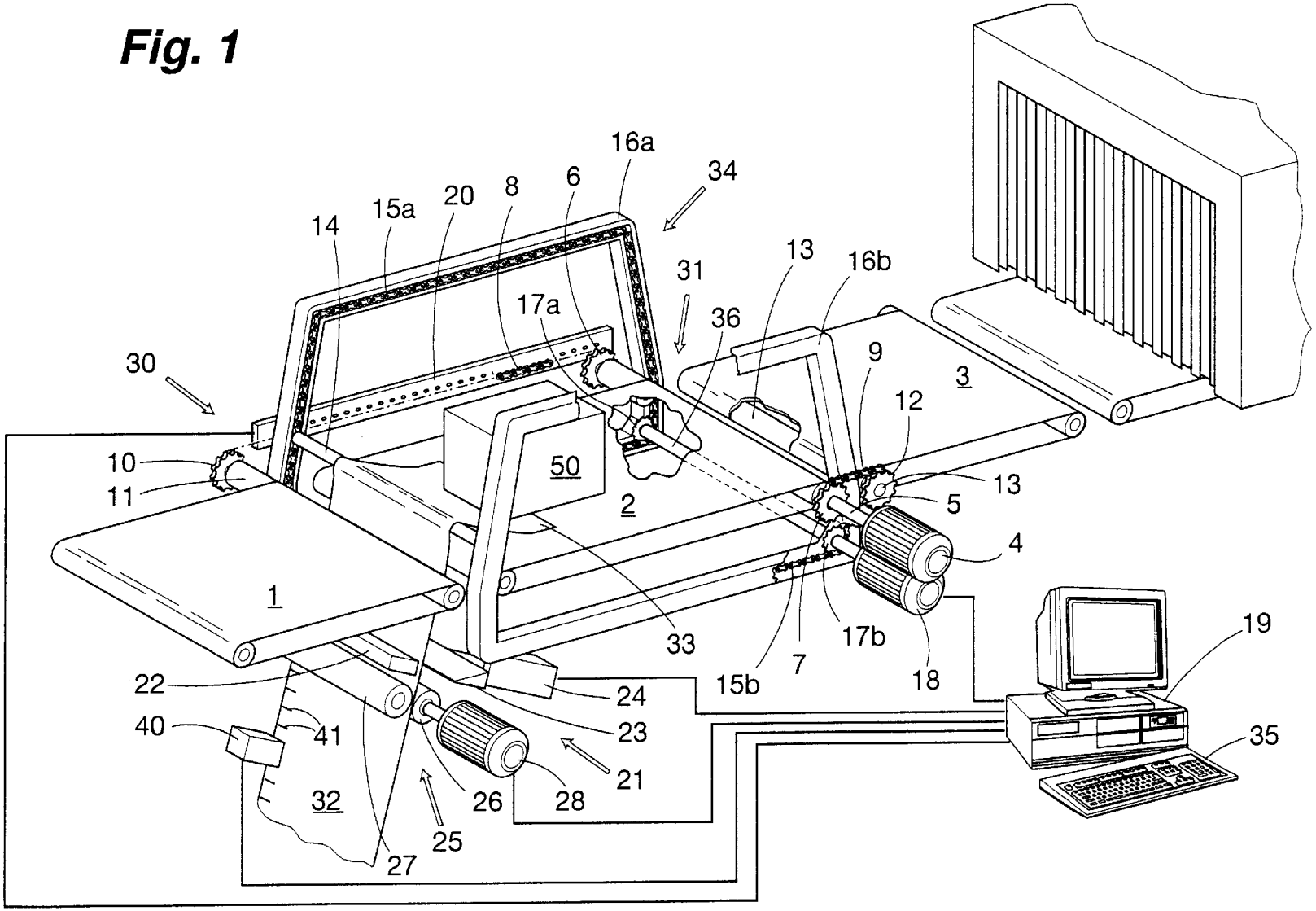
FIG. 1 is a schematic perspective view of the packaging machine which is the subject of the present invention.

As seen in FIG. 1, the machine comprises three conveyors 1, 2 and 3, which are disposed in series one after another, and are slightly spaced longitudinally, in order to define a first aperture 30 between the conveyors 1 and 2, and a second aperture 31 between the conveyors 2 and 3.

A motor 4, of the electric type, actuates a shaftroller 5, around which the second conveyor 2 passes. At its opposite ends, there are keyed onto the shaft roller 5 toothed rings 6 and 7, around which there pass chains 8 and 9, such that the first chain, indicated as 8, is looped round a toothed ring 10, which is keyed onto a shaftroller 11, around which the first conveyor 1 passes and the second chain; which is indicated as 9, is wound around a toothed ring 12, which is keyed onto a shaftroller 13, around which the third conveyor 3 is passes.

The second conveyor 2, i.e. the wrapping conveyor, is associated with wrapping means, which are generally indicated as 34, and consist substantially of at least one transverse wrapping bar 14, which orbits around the said second conveyor 2, and passes through the said first aperture 30 and the said second aperture 31. The bar 14 has own opposite ends supported by two respective chains 15*a* and 15*b*, which are disposed opposite one another, and are moved along respective parallel planes which extend longitudinally and vertically, laterally relative to the second conveyor 2, and are designed to slide inside grooves provided in respective frames 16*a*, 16*b*, which are illustrated here schematically.

The chains 15*a* and 15*b* are actuated by means of a pair of toothed sprockets 17*a* and 17*b*, which are keyed onto the ends of a single shaft 36, which in turn is actuated by a first servomotor 18, of the speed and phase control type, for example a brushless motor which is provided with servocontrol, and is connected to a programmable control unit 19, PLC and/or computer and/or the like, which is programmable by means of a keyboard 35.

Along one side of the conveyor 2, at a height which is the same as that along which the objects are moved, there is provided a position detector 20, for example of the opto-electronic type, which extends longitudinally, and is also connected to the programmable control unit 19.

In the area beneath the conveyor 2, in the vicinity of its upstream end, there are disposed the means for supplying the packaging material, which comprise cutting units 21, and, disposed further upstream relative to the direction of supply of a continuous strip 32, there are the supply units 25.

The cutting units 21 substantially comprise a counter-blade 22 and a blade 23, which extend transversely relative to the strip 32, such that the blade 23 is actuated by an actuator 24 of the electromagnetic and/or pneumatic type and/or of a known type, which is connected to the programmable control unit 19.

The supply units 25 substantially comprise a pair of rollers 27 and 26, which are preferably rubberized, between which the continuous strip 32 is engaged, such that the roller 26 is actuated by a second servomotor 28, of the speed and phase control type, for example a brushless motor which is provided with servocontrol, which is also connected to the programmable control unit 19.

Upstream from the said supply units 25, there are disposed means for controlling unwinding of the bobbin containing the continuous strip 32, which are not described or illustrated here, since they are beyond the scope of the present invention, and are known to persons skilled in the art.

As can be seen from FIGS. 2 to 8, the objects 50, 50*a* and 50*b* are supplied in individual succession and with continual motion from an upstream end towards a downstream end of the machine, and are translated longitudinally from one conveyor to the other.

When an object 50 (FIG. 2) reaches the first conveyor 1, it is translated towards the conveyor 2, and the position detector 20, which is disposed laterally relative to the conveyor 2, detects its position during its continual longitudinal advance in the downstream direction.

When the object 50 reaches the position in which it straddles the first 1 and the second 2 conveyor, the programmable control unit 19, which has previously been programmed, has disposed the cutting units 21 in a non-operative position, i.e. with the blade 23 in a position which is spaced relative to the counter-blade 22, and the supply units 25 for the strip 32, which consist of the rollers 26 and 27 and of the servomotor 28, are active and controlled by the programmable control unit 19, in order to supply the continuous web 32, at a speed of advance such that the front end 33 of the strip 32 is disposed at the intake end of the second conveyor 2, in phase with arrival of the object 50, and the strip 32 is then supplied at a speed of advance which is substantially equivalent to the speed of advance of the objects 50.

Figure 3:
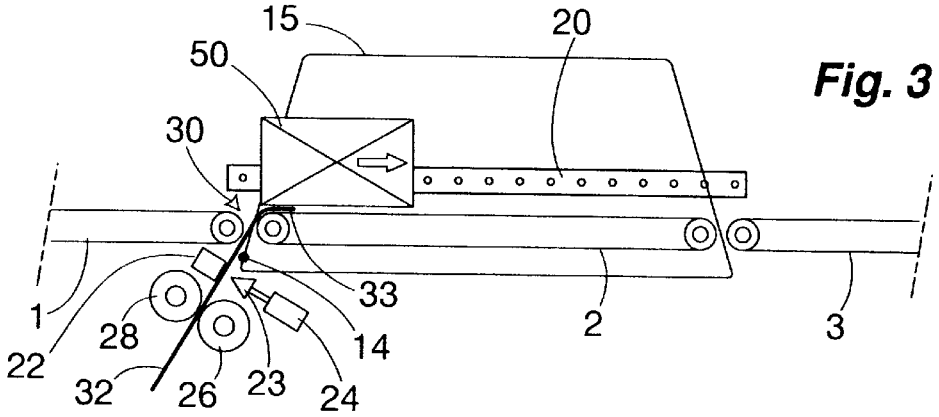

In this operative situation, as the object 50 and the strip 32 advance, see FIG. 3, the front end 33 of the strip itself is interposed between the bottom of the object 50 and the transport surface of the conveyor 2, while the detector 20 monitors the position of continual longitudinal advance of the object 50.

When the detector 20 informs the programmable control unit 19 that the rear end of the object 50 has passed beyond the first aperture 30, again see FIG. 3, the programmable control unit 19 itself, by acting on the servomotor 18, lifts the transverse wrapping bar 14 against the continuous strip 32, and subsequently, see FIG. 4, upwards and downstream, thus drawing the continuous strip above the object and in the downstream direction, until the said bar 14 and the corresponding strip 32 are taken further forwards than the rear end of the object 50. During this step of drawing the strip 32, which is carried out by the bar 14, the programmable control unit 19, by acting on the servomotor 28, supplies the strip 32 at a speed which is greater than the previous speed, and substantially at a speed such as to compensate for the existing requirement for the strip.

Figure 4:
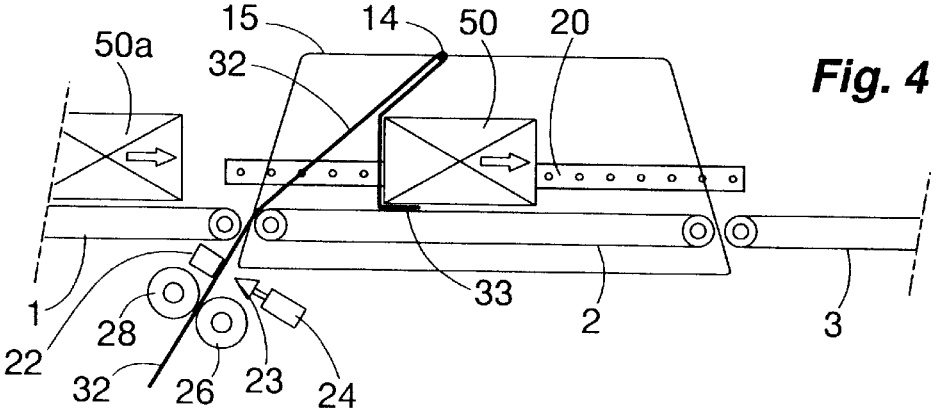

When the bar 14 reaches a specific position of its path of longitudinal advance in the downstream direction, which has previously been set in the programmable control unit 19, in which the bar 14 and the corresponding strip 32 are further forwards than the rear end of the object 50, which is advancing with continual motion, and in which a required length of the strip 32 has been extracted, as illustrated in FIG. 4, the programmable control unit 19 stops the longitudinal advance movement of the bar 14 by stopping the servomotor 18, and simultaneously suspends the supply of the continuous strip 32, by means of stoppage of the roller 26, by stopping the servomotor 28.

Figure 4A:
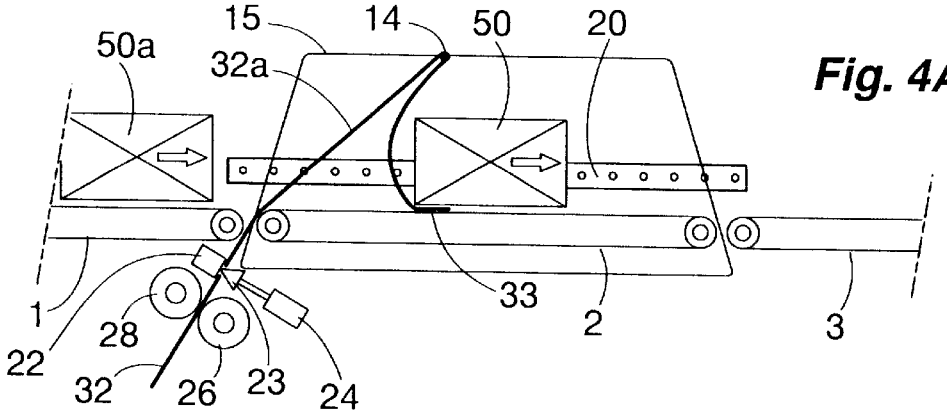

In this operative situation, the strip 32 is stationary, and the programmable control unit 19, by acting on the actuator 24, see FIG. 4A, drives the blade 23 against the counterblade 22, in order to cut off easily the continuous strip 32, and to obtain a piece 32*a*.

In the period of time which is necessary in order to cut off the strip 32, in which the bar 14 and the supply of the strip are at a standstill, the object 50, which had its rear end disposed further upstream than the wrapping bar 14 when stopped, again see FIG. 4, continues to advance, see FIG. 4*a*, and in this context it should be pointed out that further supply of strip 32 is not necessary during the advance, since the portion of strip 32 which has previously been extracted is used.

Figure 5:
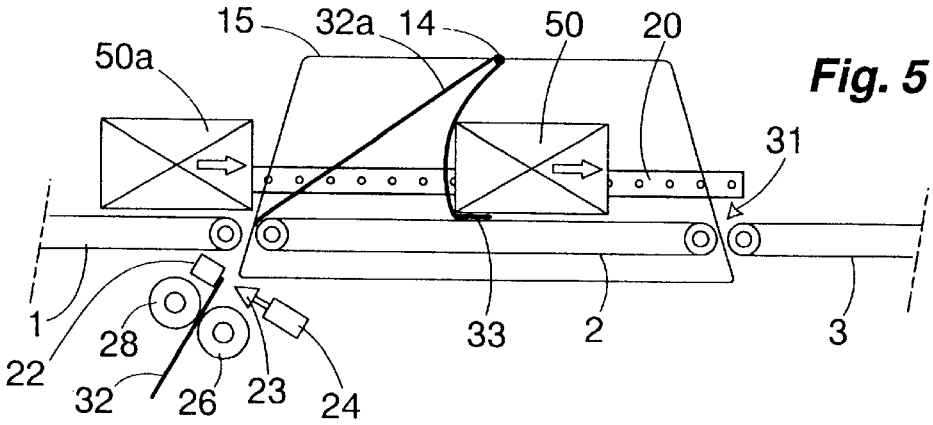

After the piece 32*a* has been cut off, see FIG. 5, the blade 22 is returned to the rest position, for example by means of known resilient return means, and, again on the basis of prior programming, the programmable control unit 19 re-activates the servomotor 18, with consequent resumption of the movement of longitudinal advance of the transverse wrapping bar 14.

Figure 6:
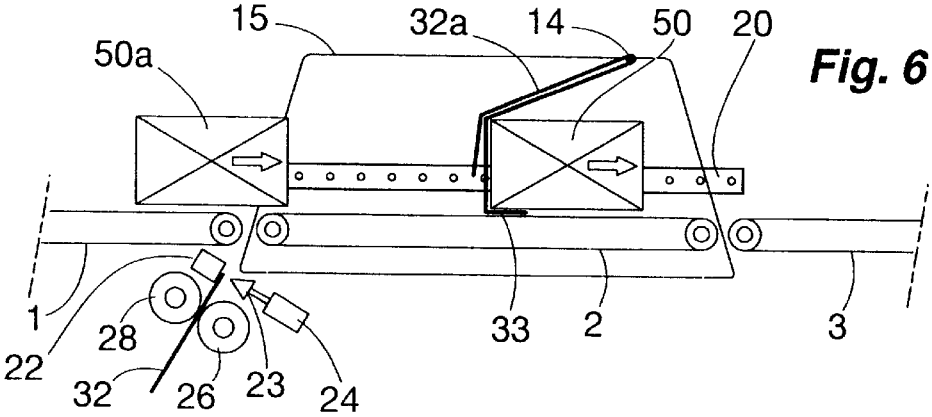
Figure 7:
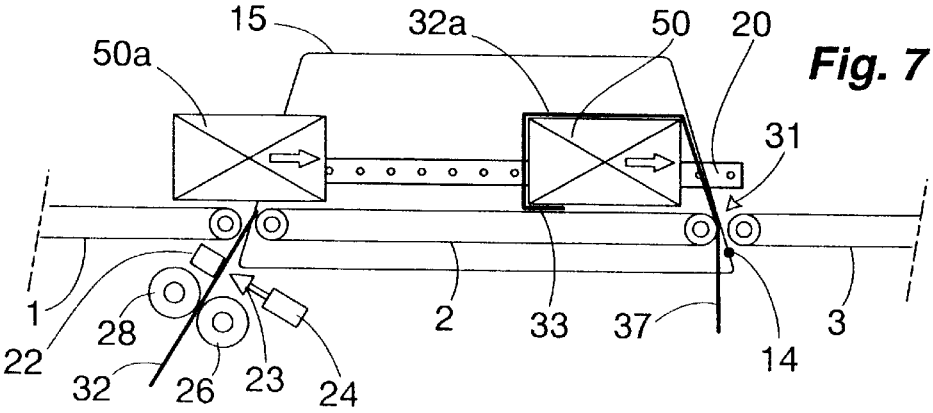

With reference to FIGS. 6 and 7, the speed of advance of the transverse wrapping bar 14, which is imparted by the servomotor 18, which in turn is controlled by the programmable control unit 19, is such as to take the wrapping bar 14 itself beyond the object 50 and downwards, as far as below the transport surface of the conveyors 2 and 3, by making it pass through the said second aperture 31, before the object 50 reaches the said second aperture 31, see FIG. 7, in order to make the end part 37 of the piece 32*a* dangle between the said second conveyor 2 and the said third conveyor 3.

Figure 8:
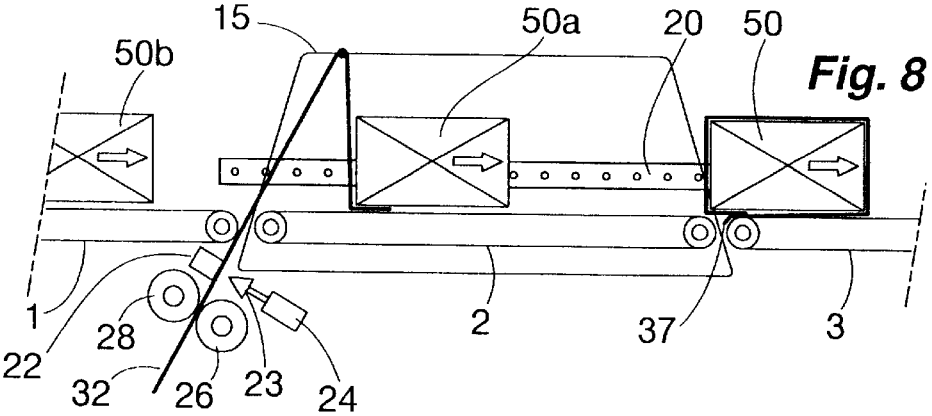

Finally, see FIG. 8, the object 50 is translated from the second conveyor 2 to the third conveyor 3, thus disposing the end part 37 of the piece 32*a* beneath the object 50, and beneath the initial part 33 of the piece 32*a* itself.

With reference to the preceding description, if it is necessary to modify the length of the piece 32*a*, in order to package an object which has a wrapping perimeter which is larger or smaller, i.e. in order to carry out the change of format by means of the programmable control unit 19 which acts on the servomotor 18, a different position of stoppage of the bar 14 is set, along its path of longitudinal advance in the downstream direction, such that, more specifically, the bar 14 is stopped further upstream than the position shown in FIG. 4, in order to obtain a piece which has a shorter length, and conversely, the bar 14 is stopped further downstream than the position shown in FIG. 4, in order to obtain a piece which has a longer length. In this context, however, it is understood that the different positions of stoppage of the bar 14 must always be disposed further downstream (further forwards) than the rear end of the object 50 which is advancing, in order, during the step of cutting off of the stationary strip 32, to bring together the stationary bar 14 and the rear part of the advancing object 50, such that supply of the strip 32 is not required during the step of cutting off with the strip stationary, even though the object 50 continues to advance.

Again with reference to the preceding description, in order to modify the length of the piece 32*a* for a change of format, also by means of the programmable control unit 19, which acts on the servomotor 28, which actuates and controls the supply units 25 for the strip 32, it is possible to set a different phase ratio between the objects 50 which reach the conveyor 2, and the supply units 25 themselves, in order to position the front end 33 of the strip 32 further upstream or downstream, relative to the longitudinal extension of the object 50. More specifically, while maintaining the same stoppage position for the bar 14 as that indicated in FIGS. 4 and 4A, when the end 33 of the said strip 32 is inserted sooner than indicated in FIGS. 2 and 3, i.e. when the front end 33 is disposed further downstream relative to the longitudinal extension of the object 50, a piece with a longer length is obtained, and conversely, when the end 33 of the said strip 32 is inserted later than indicated in FIGS. 2 and 3, i.e. when the front end is disposed further upstream relative to the longitudinal extension of the object 50, a piece with a shorter length is obtained.

Figure 2:
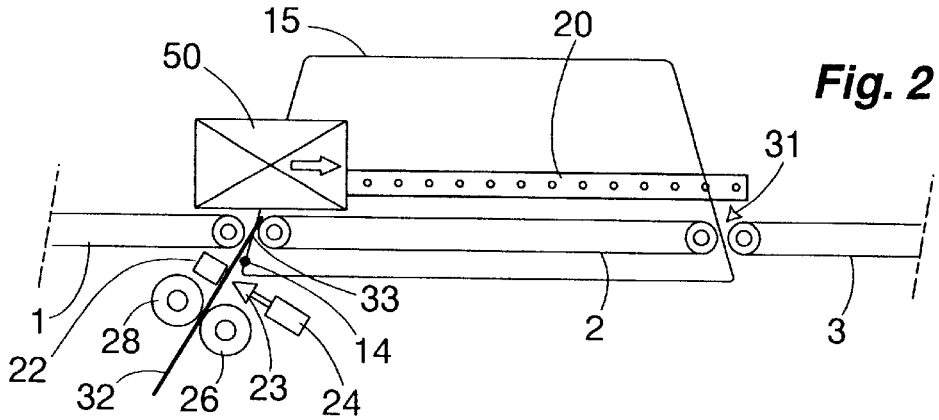
FIGS. 2, 3, 4, 4A, 5, 6, 7 and 8 are lateral schematic views, which are designed to illustrate the operative method which is the subject of the present invention, implemented by using a first embodiment of the wrapping bars.

This possibility of setting a different phase ratio between the objects which reach the conveyor 2, and the supply units 25 themselves, in order to position the front end 33 of the strip 32 further forward or backward relative to the longitudinal extension of the object 50, also makes it possible to be able to change the stop position of the bar 14, while keeping the length of the piece 32*a* constant, and more specifically, by inserting the end 33 of the said strip 32 further forwards than indicated in FIGS. 2 and 3, it is possible to dispose further upstream the stop position of the wrapping bar 14, and conversely, when the end 33 of the said strip 32 is inserted further back than indicated in FIGS. 2 and 3, it is possible to dispose further downstream the stop position of the wrapping bar 14.

With reference to the preceding description, by acting on the programmable control unit 19, it is possible to vary the longitudinal stop position of the wrapping bar 14, and/or the position of insertion of the front end 33 of the strip 32, relative to the longitudinal extension of the base of the object 50 to be packaged, such that substantially, it is possible to set easily and quickly the optimum parameters for wrapping of objects which have various shapes and/or various dimensions, and/or various ratios of height to length, without having to replace the so-called "proportioned parts".

Second embodiment of an operative machine

FIGS. 9 to 15 illustrate the operative method which is the subject of the present invention, implemented using a second embodiment of an operative machine, in which, substantially, the wrapping means for transporting the strip 32 and the individual pieces 32*a* comprise at least one pair of bars, indicated as 14 and 14*a*, which are disposed in succession one after another.

Figure 9:
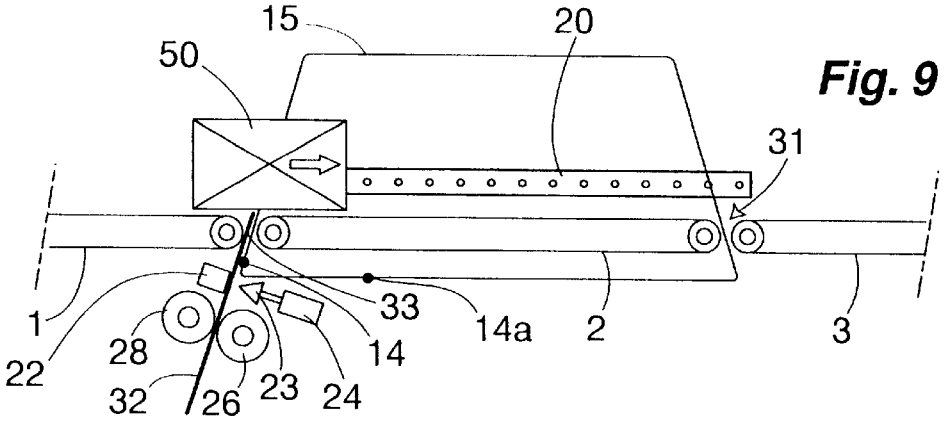
FIGS. 9, 10, 11, 11A, 12, 13, 14 and 15 are lateral schematic views, which are designed to illustrate the operative method which is the subject of the present invention, implemented by using a second embodiment of the wrapping bars.
Figure 10:
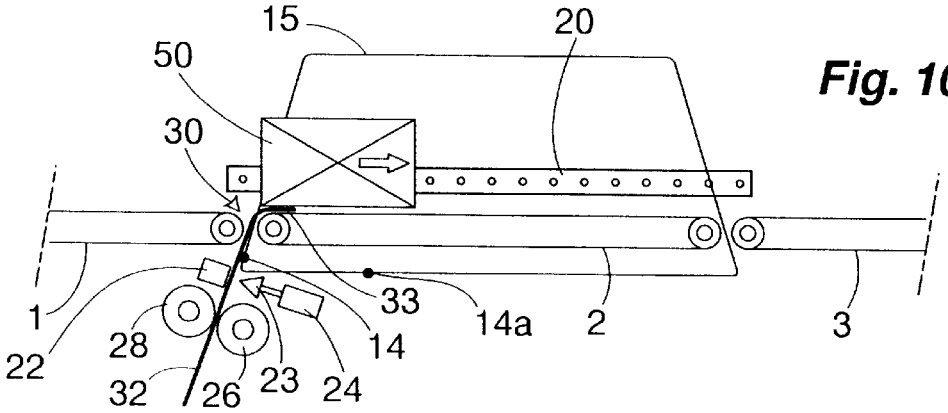
Figure 11:
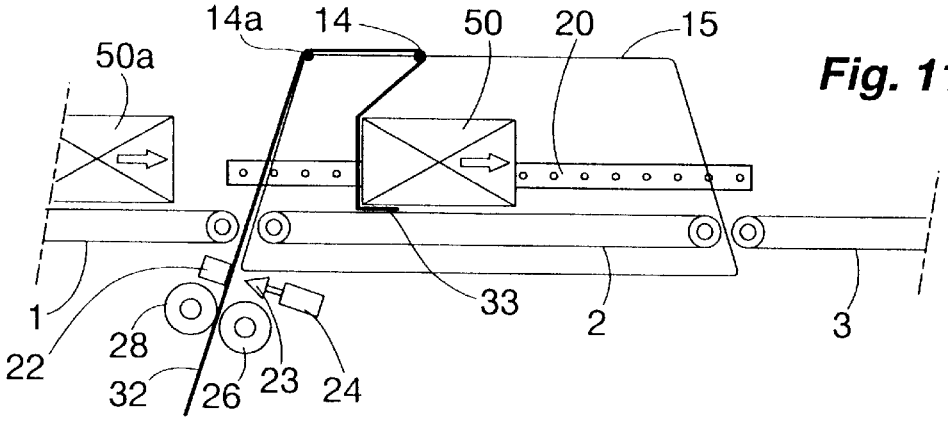

With reference to FIGS. 9, 10 and 11, and as in the preceding embodiment, the objects 50, 50*a* and 50*b* are translated from upstream towards downstream with continuous motion, and the front end 33 of the strip 32 is disposed between the base of the object 50 and the conveyor 2.

When the object 50 has passed beyond the aperture 30, the transverse wrapping bars 14 and 14*a*, which are disposed in succession one after the other, support a portion of strip 32 which is being supplied upwards and in the downstream direction, and the transverse bar 14 and the corresponding strip 32 are disposed further downstream than the rear end of the object 50 which is advancing with continual motion.

Figure 11A:
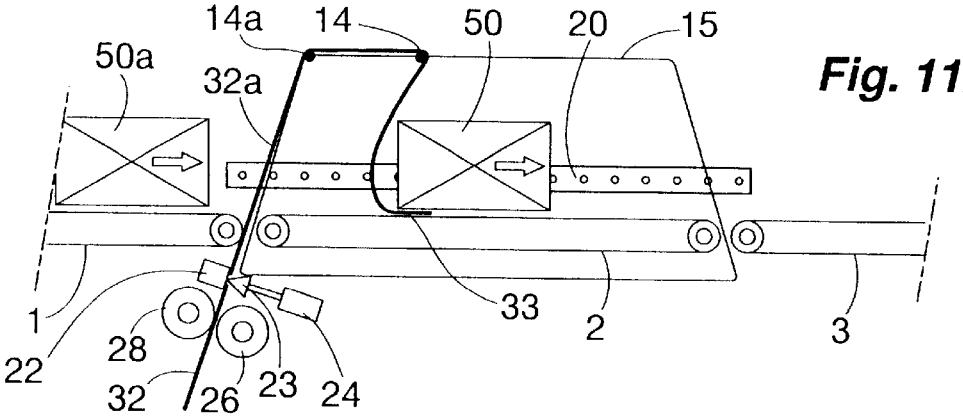

When the bar 14 reaches a specific position of its path of longitudinal advance, which is illustrated here in FIG. 11, the programmable control unit 19, as in the previous case, commands stoppage of the movement of longitudinal advance of the bars 14–14*a*, by acting on the servomotor 18, and suspension of the supply of the strip 32, by acting on the servomotor 28, and then, see FIG. 11A, cutting off of the strip 32, by acting on the actuator 24, in order to obtain the piece 32*a*.

In this embodiment also, during the period of time which is necessary for cutting of the strip 32, in which the two bars 14–14*a* and the supply of the strip 32 are at a standstill, the object 50, which had its rear end disposed further upstream than the wrapping bar 14 when stopped, again see FIG. 11, has continued to advance, see FIG. 11A, and during the said advance, further supply of strip 32 is not necessary, since the portion of strip 32 which has previously been extracted and carried by the bar 14 further downstream than the rear end of the said object 50 is used.

Figure 12:
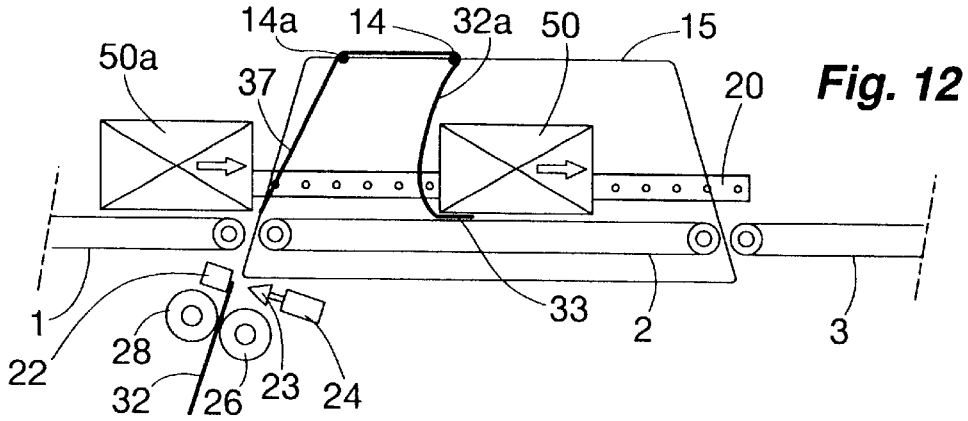
Figure 13:
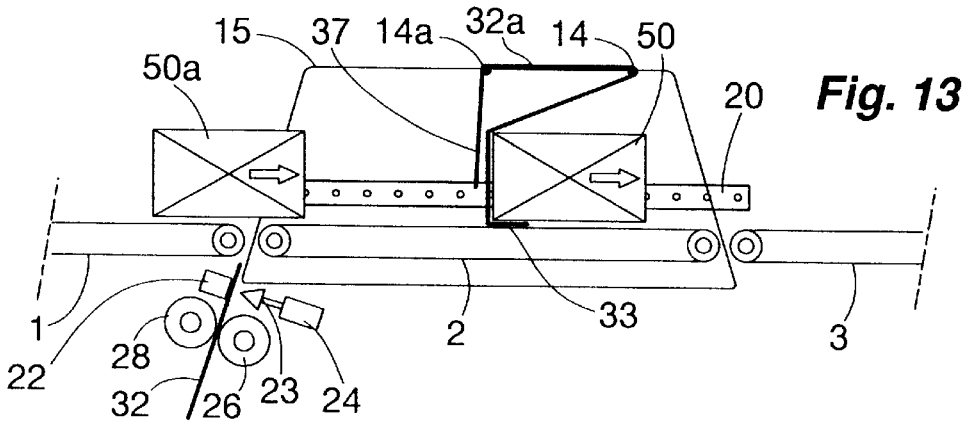

After the piece 32*a* has been cut off, see FIG. 12, the programmable control unit 19 commands actuation of the servomotor 18, with consequent resumption of the movement of longitudinal advance of the bars 14 and 41*a*, and more specifically, see also FIG. 13, the bar 14 wraps the piece around the object 50 as previously described, whereas in this case, the bar 14*a* supports the end part 37 of the piece 32*a* itself, in order to keep it spaced from the object 50, in order to prevent undesirable contacts/adhesions between the said end part 37 and the part of the piece 32*a* itself which has already been wrapped, since these contacts/adhesions are particularly undesirable in view of the known electrostatic charges to which some plastic packaging materials are subject.

Figure 14:
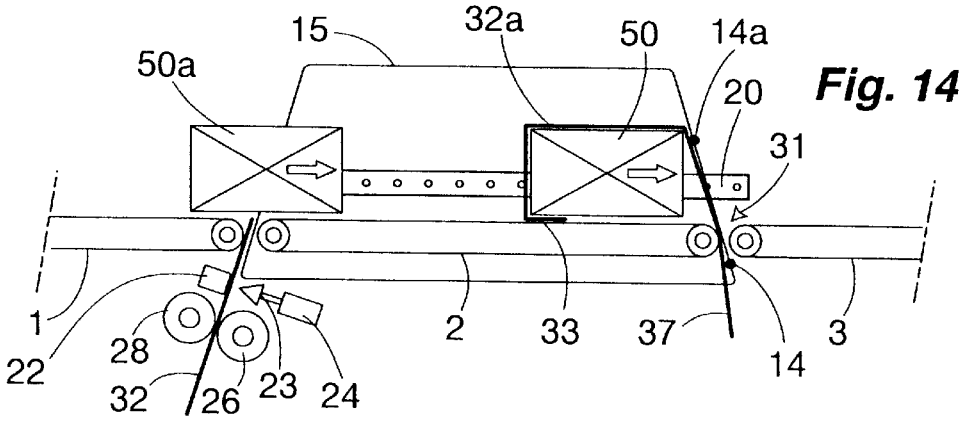
Figure 15:
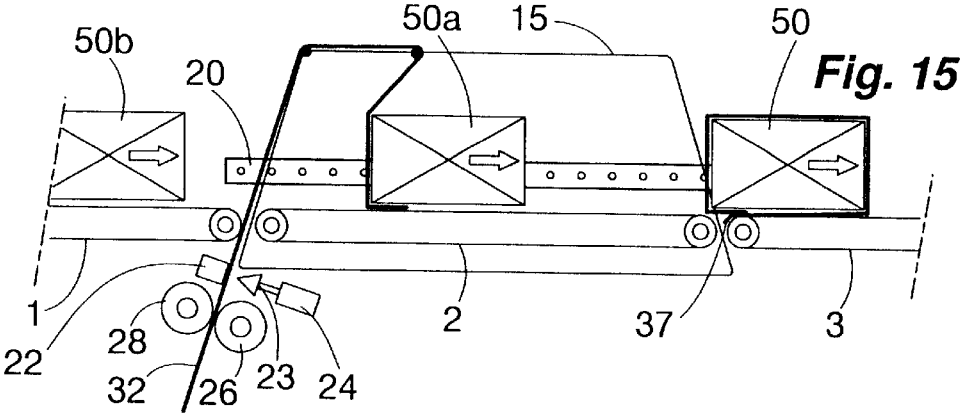

With reference to FIGS. 14 and 15, by being passed through the second aperture 31, the bar 14 and the bar 14*a* are taken below the surface of translation of the objects, before the object 50 reaches the aperture 31, in order to make the final end 37 of the piece 32*a* dangle between the said second 2 and the said third 3 conveyor, see FIG. 14, in order, as in the preceding case, for the end part 37 of the piece 32*a* to be folded beneath the initial part 33 of the piece 32*a* itself, by means of translation of the object 50 from the said second conveyor 2, to the said third conveyor 3.

Again with reference to FIG. 1, optionally, the machine which is the subject of the present invention can also be provided with a reading device 40, for example an optical reader of the optoelectronic type, which is disposed before the cutting units 21, is connected to the programmable control unit 19, and is designed to read marks 41 which are disposed longitudinally in succession along the continuous strip 32, in order to communicate to the programmable control unit 19 the stage of advance of the strip 32 itself during the packaging operations.

By means of this configuration, it is possible to control continuously and accurately the quantity of material supplied, and, for example, by counting the marks 41 which succeed one another, it is possible to determine the length of strip which has been unwound since the previous cut, in order to cut the pieces 32*a* to a length which is millimetrically accurate and calibrated.

In addition, again in this configuration, it is also possible to provide automatic adjustment of the supply of the strip 32, in order to correct any errors of excessive or insufficient supply by the supply units 25 of the strip 32, caused for example by possible slippage (relative movements) between the strip 32 and the rollers 26–27. In fact, if the programmable control unit 19 is provided with a pre-adjusted management and control programme, which, briefly, serves the purpose of measuring the quantity of strip supplied in relation to the signals received from the reading device 40, in order then to act on the servomotor 28 and/or on the servomotor 18, of the speed and phase control type, it is possible to supply a greater or lesser quantity of the strip 32 in the wrapping operative cycle in progress, and/or in the successive cycles, in order to compensate for any errors detected.

The said technical-functional characteristic is required in particular in the case of packaging units with strip material which is provided with successive decorative motifs, in which, in order to ensure that the image of the motif is in the correct position on the object to be packaged, the front end 33 of the strip 32 must be supplied accurately in phase with the arrival of the objects 50, and in addition, the strip 32 itself must be cut off at a specific point of its longitudinal extension, in order to ensure that the motif is in the correct position relative to the length of the pieces 32*a*, and in order to avoid phase displacement of the supply for cutting of the successive pieces with corresponding decorative motifs.

With reference to the description which illustrates the operative method and the corresponding machine, it is apparent that the latter can also be implemented with a different machine structure, of the electrical and/or electronic and/or mechanical type, without departing from the operative concepts expressed in the following claims.

The description of the above-described operative methods and machines are provided purely by way of non-limiting example, and it is thus apparent that all changes and/or variants can be made to them which are suggested by practice and by their utilization or use, within the scope of the following claims.

What is claimed is:

1. A method for packaging of objects by means of pieces of sheet material, obtained from a continuous strip, in an automatic packaging machine which wraps pieces of packaging material around the objects, in which the said machine comprises:

first conveyor means which can supply the objects longitudinally in spaced succession;

second conveyor means, which are disposed downstream and slightly spaced relative to the said first conveyor means, thus providing a first aperture between the said first and the second conveyor means, and can translate the objects longitudinally along a wrapping surface which has an intake end and an output end;

third conveyor means, which are disposed downstream and slightly spaced relative to the said second conveyor means, thus providing a second aperture between the said second and the said third conveyor means, which can collect longitudinally the objects presented by the said second conveyor means;

wrapping means, which are disposed in the vicinity of the second conveyor means, and include at least one suspended wrapping bar, which is oriented transversely relative to the direction of advance of the objects, and is designed to be translated through the said first and the said second aperture, along an orbital path which circumscribes the said conveyor means, and is designed to transport the packaging material;

strip supply means, which are disposed beneath and aligned in the vicinity of said intake end of the second conveyor means, and are designed to supply a continuous strip of packaging material;

cutting means, which are disposed between the strip supply means and the intake end of the second conveyor means, and are designed to cut the continuous strip of packaging material transversely; and synchronization means, which are designed to synchronize the said means with one another;

said method comprising the steps of:

advancing said objects with continual motion, in individual succession, from an upstream side towards downstream side, and in that for each object to be packaged, a) supplying a front end of the strip towards the intake end of the said second conveyor means, in phase with the arrival of the object on the said second conveyor, the said front end of the strip being disposed between the object and a transport surface of the second conveyor means;

b) passing of a transverse wrapping bar upwards through the said first aperture, when the rear end of the object has passed beyond the said first aperture, and drawing the strip supplied above the object and in the downstream direction;

c) stopping the said transverse wrapping bar during its path of advance downstream, in a specific position which is further forward than the rear end of the object, which advances with continual motion;

d) simultaneously with the preceding step c), stopping the said means for supply of the strip of packaging material;

e) actuating the cutting means and cutting off of the strip which is rendered stationary, thus obtaining a separated piece;

f) resuming the advance in the downstream direction of the transverse wrapping bar, and conveying the bar beyond the object and then downwards, making it pass through the said second aperture before the object reaches the second aperture, dangling an end part of the piece between the said second conveyor means and the said third conveyor means; and g) translating the object from the second conveyor means to the third conveyor means, and placing the end part of the piece beneath the object.

2. The method according to claim 1 wherein a position of stoppage of the transverse wrapping bar in step (c) is varied along its path of advance from upstream towards downstream sides as a function of a required length of said piece.

3. The method according to claim 1 wherein the position of insertion of the front end of the strip is varied relative to the longitudinal extension of the base of the object to be packaged, while the said object is being advanced from the first conveyor means to the second conveyor means.

4. The method according to claim 1 wherein a position of stoppage of the transverse wrapping bar in step (c) in varied along its path of advance from upstream towards downstream, sides as a function of a required length of said piece and/or the position of insertion of the front end of the strip is varied relative to the longitudinal extension of the base of the object to be packaged, while the said object is being translated from the first conveyor means to the second conveyor means as a function of size of the object.

5. A machine for packaging of objects by means of pieces of sheet material, obtained from a continuous strip, in an automatic packaging machine which wraps pieces of packaging material around the objects, in which the said machine comprises:

first conveyor means for supplying the objects longitudinally in spaced succession;

second conveyor means disposed downstream and slightly spaced relative to the said first conveyor means, thus providing a first aperture between the said first and the second conveyor means, for translating the objects longitudinally along a wrapping surface of said second conveyor means which has an intake end and an output end;

third conveyor means disposed downstream and slightly spaced relative to the said second conveyor means, thus providing a second aperture between the said second and the said third conveyor means, for collecting longitudinally objects presented by the said second conveyor means;

wrapping means disposed in the vicinity of the second conveyor means and including at least one suspended wrapping bar, which is oriented transversely relative to the direction of advance of the objects, for passage through the said first and the said second aperture, along an orbital path which circumscribes the said conveyor means, and transporting the packaging material;

strip supply means disposed beneath and aligned in the vicinity of said intake end of the second conveyor means, for supplying a continuous strip of packaging material;

cutting means disposed between the strip supply means and the intake end of the second conveyor means, for cutting the continuous strip of packaging material transversely;

synchronization means for synchronizing the first conveyor means, the second conveyor means, the third conveyor means, the wrapping means, the strip supply means and the cutting means with one another; and detection means disposed along a longitudinal extension of the second conveyor means for detecting a position of longitudinal advance of the objects, said wrapping means being actuated by a first servomotor with speed and phase control said strip supply means comprising units for supplying the strip which are actuated by means of a second servomotor with speed and phase control, said synchronization means comprising a programmable control unit, which is connected to the said detection means for controlling the said first servomotor, the said second servomotor, and the said cutting means and programmed to carry out the following steps:

a) supplying a front end of the strip towards the intake end of the said second conveyor means, in chase with the arrival of the object on the said second conveyor, the said front end of the strip being disposed between the object and a transport surface of the second conveyor means;

b) passing of a transverse wrapping bar upwards through the said first aperture, when the rear end of the object has passed beyond the said first aperture, and drawing the strip supplied above the object and in the downstream direction;

c) stopping the said transverse wrapping bar during its path of advance downstream, in a specific position which is further forward than the rear end of the object, which advances with continual motion;

d) simultaneously with the preceding step c), stopping the said means for supply of the strip of packaging material;

e) actuating the cutting means and cutting off of the strip which is rendered stationary, thus obtaining a separated piece;

f) resuming the advance in the downstream direction of the transverse wrapping bar, and conveying the bar beyond the object and then downwards, making it pass through the said second aperture before the object reaches the second aperture, dangling an end part of the piece between the said second conveyor means and the said third conveyor means; and g) translating the object from the second conveyor means to the third conveyor means, and placing the end part of the piece beneath the object.

6. The machine according to claim 5 wherein said wrapping bar means comprises at least one pair of transverse wrapping bars which are supported in succession one after the other, the bar which is further forward in the said pairs of bars transporting the strip and the piece during wrapping, and the second bar which is further back in the said pair of bars supporting the end part of the piece.

7. The machine according to claim 5, further comprising a reading device, which is disposed ahead of the cutting means, the reading device reading marks which are disposed along the strip, said reading device being connected to the programmable control unit.

* * * * *